United States Patent [19]

Papa

[11] 4,220,291

[45] Sep. 2, 1980

[54] APPARATUS FOR WINDING TAPE ON CORES

[76] Inventor: Robert B. Papa, 127 Midvale Dr., Cranston, R.I. 02920

[21] Appl. No.: 70,303

[22] Filed: Aug. 27, 1979

[51] Int. Cl.[3] ..... B65H 19/04; B65H 75/24

[52] U.S. Cl. ..... 242/56.9; 242/72 B

[58] Field of Search ..... 242/56.3, 56.9, 68, 242/68.2, 68.3, 68.4, 72, 72 B

[56] References Cited

U.S. PATENT DOCUMENTS

| | | | |
|---|---|---|---|
| 3,552,672 | 1/1971 | Grettve | 242/72 B |
| 3,853,280 | 12/1974 | Pennisi | 242/72 B |
| 3,878,999 | 4/1975 | Daves | 242/56.9 |
| 4,026,488 | 5/1977 | Hoshimoto | 242/72 B |
| 4,026,491 | 5/1977 | Bostvoem | 242/56.9 |

*Primary Examiner*—Edward J. McCarthy

*Attorney, Agent, or Firm*—Robert J. Doherty

[57] ABSTRACT

Apparatus for holding a plurality of cylindrical cores while strip material such as tape is simultaneously wound thereon. The device includes a mandrel of generally overall cylindrical shape in which at least a pair of slat segments are adapted to move radially outwardly and inwardly with respect to the mandrel. Each slat additionally includes a plurality of laterally circumferentially extending longitudinally spaced grooves in which the cores are positioned and a groove base wall having an opening through which a pressure member is adapted to extend so as to apply a local pressure to the interior portions of the cores. When the slats are radially expanded as by the application of fluid pressure to a bladder, frictional holding force is applied to the cores so as to better control the winding tension of the tape strips being wound thereon.

5 Claims, 5 Drawing Figures

APPARATUS FOR WINDING TAPE ON CORES

BACKGROUND AND SUMMARY OF THE INVENTION

This invention relates to winding strips into roll form and more particularly to an apparatus for holding a plurality of cylindrical winding cores such that strip material may be simultaneously wound thereon at a desired level or levels of tension.

It is common to convert wide rolls of resin materials such as polyolefins, polyesters and the like into multiple strips of lesser width and thereafter wind such lesser width strips into roll form. Normally a cylindrical winding core made of paper or paper-type composition is used for this purpose. The lesser width wound rolls of strip material so formed are useful as photographic films and in the formation of pressure-sensitive adhesive tapes. Thus a web of pressure-sensitive adhesive or other material may be unwound from a wide roll, slit into multiple strips or webs of a desired lesser width and thereafter wound simultaneously into suitable lengths on individual cylindrical cores.

The cores are generally arranged in side-by-side fashion on two spaced apart mandrels whereby some of the lesser width strips of tape are wound into rolls on one mandrel and alternate strips are wound into rolls on another mandrel. These mandrels are positively driven and unless driven at a speed whereby an acceptable tension level is maintained, the resulting tape rolls can be wound either too loosely or too tightly. Either of these conditions results in tape rolls which may be unacceptable for sale, requiring either rewinding, discarding, or being sold as less than a first quality product. A common fault which results from improper tension during winding of these rolls is the coning effect often exhibited by rolls of lower-quality adhesive tape.

Various devices have accordingly been devised so as to regulate the aforementioned winding tension. For instance, in one such apparatus, the cores are positively and firmly gripped and the winding tension is controlled by regulating the driving force transmitted to the mandrel by a clutch arrangement. Although satisfactory for some purposes, such system necessitates expensive and complex equipment, and even then, unintentional slippage can occur, especially when high winding tensions are encountered during winding.

Another form of lock-core winding includes positively gripping the winding cores to the winding shafts and not allowing for any slip or differential speed to take place between the several winding cores on the same shaft or of the shaft itself. This system is advantageously simple but can only be used where differences in material thicknesses do not effect finished roll quality or where in the case of an extensible material a slight amount of material stretch may be acceptable.

It is also known to utilize various devices which permit differential core speed winding. In such systems, the cores are allowed to slip under controlled tension at a differential speed relative to the winding shaft as opposed to the lock-core winding methods. This has the desirable effect of allowing rolls supported on the same shaft to wind at different speeds relative to each other, thus compensating for differences in strip material thickness and in the case of extensible materials, causing the materials to stretch to a lesser degree. These systems generally include the use of longitudinally disposed cores and intermediate spacers wherein the cores are allowed to turn freely around the shaft and the spacers hold the cores in place. The spacers may be located on the shaft by a pin and the shaft is grooved to accept the pin and prevent the spacers from rotating. The amount of slip force may be adjusted by regulating the pressure of an expansible diaphragm mounted so as to apply an end thrust to the cores and spacers. An undesirable feature of such systems is that they require considerable set-up time to properly locate the cores and spacers upon the shaft.

Patents of which applicant is aware of and which represent various aspects of such above indicated known winding methods and modifications thereof include the following U.S. Pat. Nos.: 3,053,467; 3,667,696; 3,853,280; 3,878,999; 3,904,144; 3,908,926; 3,945,583; 4,026,488. The citation of the above patents constitutes Applicants Prior Art Statement.

It is accordingly an object of the present invention to provide an apparatus on which a plurality of winding cores may be supported during the winding of tape thereon in such a manner that a variable but uniform frictional holding force may be applied thereto in an uncomplicated and trouble-free manner.

These and other objects of the invention are accomplished by the provision of a mandrel of generally overall cylindrical shape having at least two circumferentially spaced longitudinally extending surface openings provided therein. Slat segments having an outer arcuate surface generally corresponding to that of the mandrel are positioned in each of the openings and are radially expansible with respect thereto. Each of the slats includes a plurality of lateral circumferential grooves in which the cores are adapted to rest and a localized pressure member adapted to extend at least partially through an opening formed in the base wall of such grooves. Upon expansion, both the slats and the local pressure members are forced radially outward so as to frictionally engage the inner surface portions of the cylindrical winding cores and thus accomplish the desired degree of winding tension.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
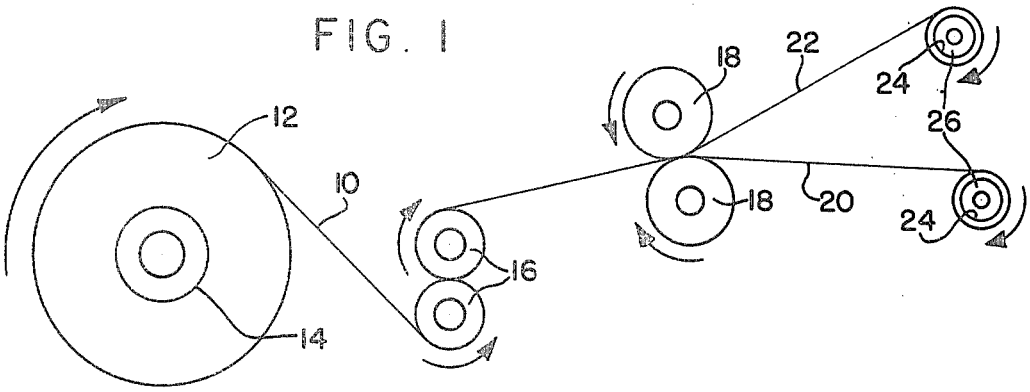
FIG. 1 is a schematic illustration of apparatus for slitting a web material into a plurality of lesser width strips and winding such strips simultaneously into rolls upon a plurality of cylindrical cores.
Figure 2:
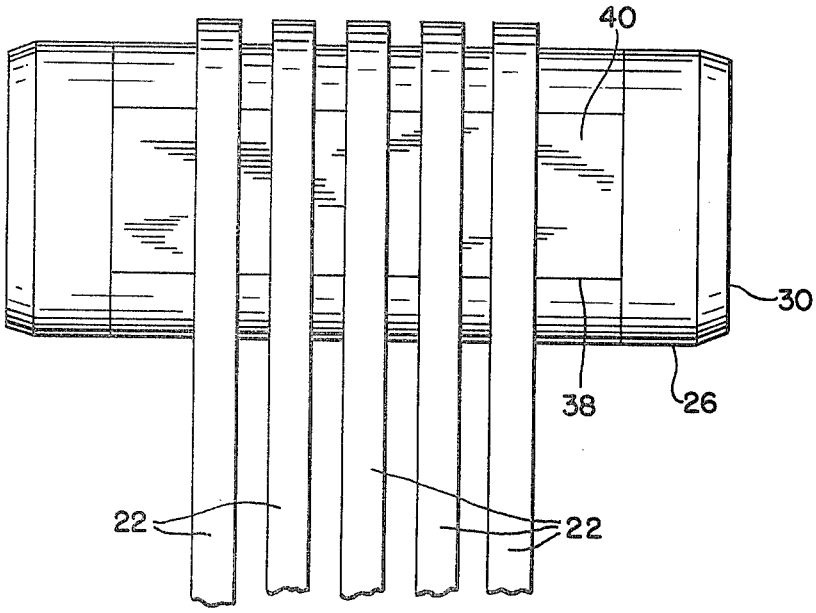
FIG. 2 is a plan view showing the narrow strips of FIG. 1 being wound into individual rolls upon the apparatus of the present invention.

Turning now to the drawings and in particular FIGS. 1 and 2 thereof, a sheet or web 10 of pressure-sensitive adhesive material is shown being unwound from a supply roll 12 thereof. The supply roll 12 is supported for rotation on an unwind shaft 14 for rotation in the direction shown by the arrow. The sheet material then passes through a pair of drive rolls 16 and thence through a pair of slitting rolls 18 wherein it is slit into a plurality of adjacent strips 20 and 22 which are thereafter respectively wound upon a plurality of cylindrical cores 24 positioned upon winding mandrels 26 constructed in accordance with the present invention. In this regard it should be understood that the strips 20 and 22 are adjacent to each other in the unslit sheet or web 10 and that accordingly alternate adjacent slit strips of the desired lesser width pass to alternate mandrels 26, each constructed in accordance with the present invention. Obviously more than two such mandrels may be utilized. Also, the cores utilized to wind the strips 20 or 22 on the outer surface thereof may be of any construction, but generally are formed of heavy paper and cut to the desired width from cylindrical tubes thereof.

Figure 3:
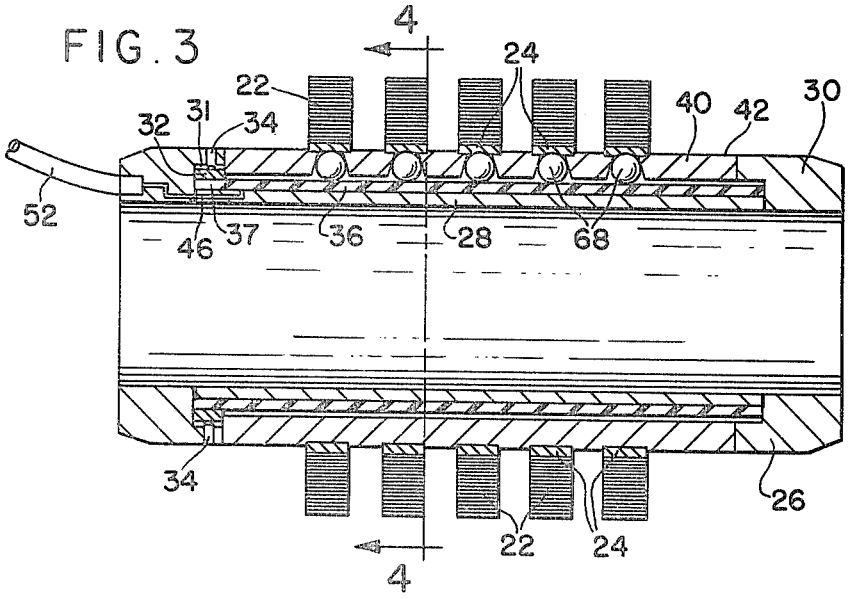
FIG. 3 is an elevational view in section illustrating portions of the present apparatus.
Figure 4:
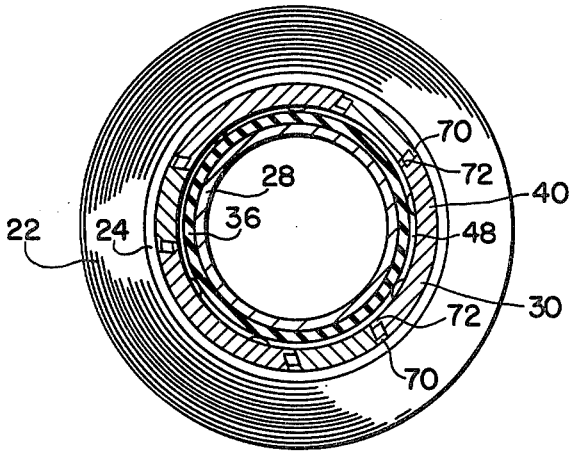
FIG. 4 is a cross-sectional end view taken along the line 4—4 of FIG. 3.
Figure 5:
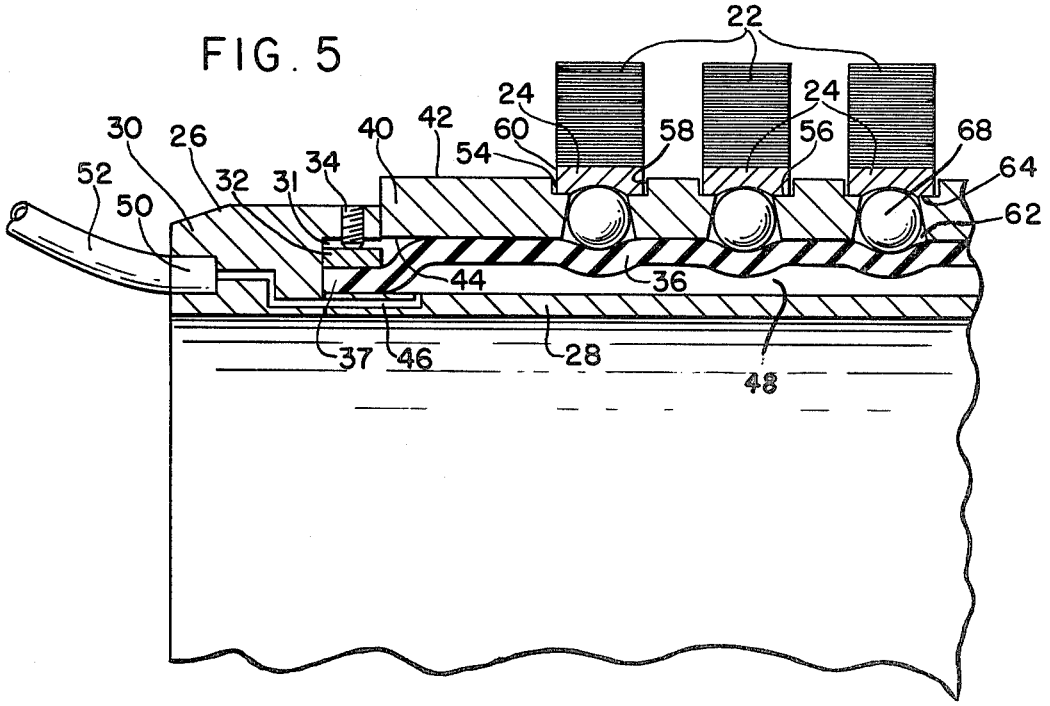
FIG. 5 is an enlarged partial sectional portion of FIG. 3, showing the device of the present invention in its expanded core-gripping position.

Turning now to FIGS. 3 through 5 of the drawings, the construction of the winding mandrel 26 of the present invention is best shown. The mandrel includes an inner generally cylindrical shell 28 and an outer also generally cylindrical shell 30. Both shells are adapted to cooperate with each other and are positioned with regard to each other in the desired fashion by means of a plurality of bolts or screws (not shown). In this regard, the outer shell 30 includes an inner radially outwardly extending recess or chamber 31 in which the respective outer ends of the inner shell 28 are adapted to be positioned. In addition, a ring 32 is disposed in each such chamber and is adapted to be moved towards and away from the upper surfaces of the inner shell 28 by means of a screw member 34. A generally cylindrical shaped bladder 36 formed from any suitable elastomeric material such as rubber and the like is disposed about the inner shell 28 and includes end portions 37 thereof positioned beneath the ring 32. In this manner then, the end portions 37 of the bladder 36 may be positively gripped between the ring and inner shell for a purpose which will hereinafter be more clearly understood.

The central portions of the outer shell 30 are provided with at least two opposed longitudinally extending openings 38. Three of four openings are normally provided. A longitudinally oriented slat 40 is adapted to extend into each such opening 38 and is radially movable in regard thereto, that is, the slats may move from a first position shown in FIG. 3 to a second or expanded position illustrated by FIG. 5. In the normal or unexpanded position of the slats 40, the arcuate outer surface 42 thereof generally is flush with or forms a continuation of the cylindrical surface of the outer shell 30. Also, the bottom surface 44 of the slats 40 is adapted to contact the upper surface portions of the bladder 36 such that upon expansion of the bladder as by the admission of air pressure thereto, the slats 40 move to such aforementioned radially outwardly expanded position. Such air pressure may be admitted beneath bladder 36, that is, between the bladder and the outer surface of the inner shell 28 by means of an air line 46 passing through one end of the outer shell 30 and opening into a chamber 48 formed between the bladder 36 and the inner shell 28. A valve 50 connected to a suitable source of compressed air, as through hose 52, may complete the means through which the bladder may be expanded. Similarly, when the air pressure in the chamber 48 is reduced or eliminated, the force and accordingly the tendency for the slats 40 to radially expand will be reduced or eliminated.

Each of the slats further includes a plurality of longitudinally spaced circumferentially extending grooves 54. Each such groove includes a base wall 56 and opposed side walls 58. The cores 24 are adapted to be mounted in the grooves 54 such that the edges 60 thereof are adapted to engage the groove side walls 58 or at least be positioned with regard thereto so as to prevent any significant back-and-forth movement of cores with respect to the slat. Additionally, each groove 54 includes a generally frustro-conical chamber 62 positioned beneath the base wall thereof and terminating in a circular opening 64 in such base wall 56. A metal ball 68 is disposed in each such chamber 62 and is adapted to engage the upper surface of the bladder at lower portions thereof and side surfaces of the chamber 62 at upper portions thereof. The diameter of the ball 68 is also such that at least portions thereof are also adapted to extend through the opening 64 in the expanded condition of the bladder 36 so as to apply localized pressure on inner surface portions of the core 24 mounted in such groove 56.

In order that the slats 40 will not move outwardly from the openings 38, adjacent positions of the outer shell 30 are provided with projections or ledges 70 which extend circumferentially from each longitudinal edge of the openings 38 thereof. Also the slats include similar projections or ledges 72 provided on their longitudinal edges. The ledges 72 are disposed at the inner radial surface of the slats while the ledges 70 are disposed at the outer radial surface of the outer shell 30, that is, the openings 38 thereof. In this manner and as best shown in FIG. 4, the ledges 72 are adapted to contact ledges 70 and thus the slats 40 are restrained from moving outwardly relative to the mandrel more than the degree to facilitate the desired slat expansion.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. Apparatus for holding a plurality of cylindrical winding cores while strip material is simultaneously wound thereon comprising, a mandrel of generally overall cylindrical shape having at least two circumferentially spaced longitudinally extending openings provided therein, a slat segment having an outer arcuate surface generally corresponding to that of said mandrel positioned in each said opening, each said slat including a plurality of longitudinally spaced grooves laterally extending across the outer surface thereof, said cores adapted for disposition over said mandrel and at least partially into said grooves and wherein the core side walls are adapted to contact sidewalls of said grooves, each said groove including a base wall having at least one opening through which a member adapted to apply local pressure to inner surface portions of said cores is adapted to radially extend, expansible means disposed in said mandrel and adapted to simultaneously contact inner surface portions of both said slats and said local pressure members whereupon expansion of said expansible means causes both said slat groove base walls and said local pressure members to be forced into frictional contact with said cores such that the holding force applied to said cores may be varied dependent on the force applied to said expansible means.

2. The apparatus of claim 1, said expansible means being an air expansible bladder, and valve means for enabling pressurized air to move into and out of said bladder.

3. The apparatus of claim 2, said bladder of bag type cylindrical construction, said mandrel having an inner shell and an outer shell, end portions of said bladder adapted to extend between said inner and outer shells at opposite ends of said mandrel.

4. The apparatus of claim 1, said local pressure member being a ball adapted to extend partially through said slat groove base wall opening into contact with the respective core positioned on said groove.

5. The apparatus of claim 4, said slats including a frusto-conically shaped chamber for receipt of said balls, said chambers terminating at their upper ends in said base wall opening.

* * * * *